United States Patent [19]

Look et al.

[11] Patent Number: 4,852,511

[45] Date of Patent: Aug. 1, 1989

[54] PORTABLE TRAFFIC BARRIER

[76] Inventors: Art Look, 76 West Rd., Lombard, Ill. 60148; Joseph Valenti, 23823 W. Rosemont La., Lake Villa, Ill. 60046

[21] Appl. No.: 162,068

[22] Filed: Feb. 29, 1988

[51] Int. Cl.[4] ..... E01F 13/00

[52] U.S. Cl. ..... 116/63 P; 116/63 R; 248/166; 248/910; 383/8; 383/41

[58] Field of Search ..... 40/606, 610, 612; 116/63 P, 63 R; 248/DIG. 10, 166; 256/64; 350/97; 404/6; 383/7-9, 12, 24, 41

[56] References Cited

U.S. PATENT DOCUMENTS

| | | | |
|---|---|---|---|
| 2,648,761 | 8/1953 | Shamel | 256/64 |
| 3,841,631 | 10/1974 | Dolan | 273/1.5 R |
| 3,877,681 | 4/1975 | Humphrey | 256/64 |
| 3,917,232 | 11/1975 | Lindner | 256/64 |
| 4,104,980 | 8/1978 | Toomey | 116/63 P |
| 4,624,210 | 11/1986 | Glass | 116/63 P |
| 4,674,432 | 6/1987 | Schmanski | 116/63 P |

FOREIGN PATENT DOCUMENTS

| | | | |
|---|---|---|---|
| 483816 | 6/1952 | Canada | 40/612 |
| 994741 | 8/1976 | Canada | 248/DIG. 10 |
| 2194268 | 3/1988 | United Kingdom | 116/63 P |

*Primary Examiner*—William A. Cuchlinski, Jr.
*Assistant Examiner*—W. Morris Worth
*Attorney, Agent, or Firm*—Haight & Hofeldt

[57] ABSTRACT

A traffic barrier is disclosed copmrising: two high visibility panels supported by a pair of legs joined by a cross-member, and a flexible substantially closed container which is supported by the legs or cross-members and adapted to be filled with a liquid for adding to the weight and stability of the structure. The liquid container allows the barrier to be easily moved, transported, and placed in use.

7 Claims, 2 Drawing Sheets

FIG. 1
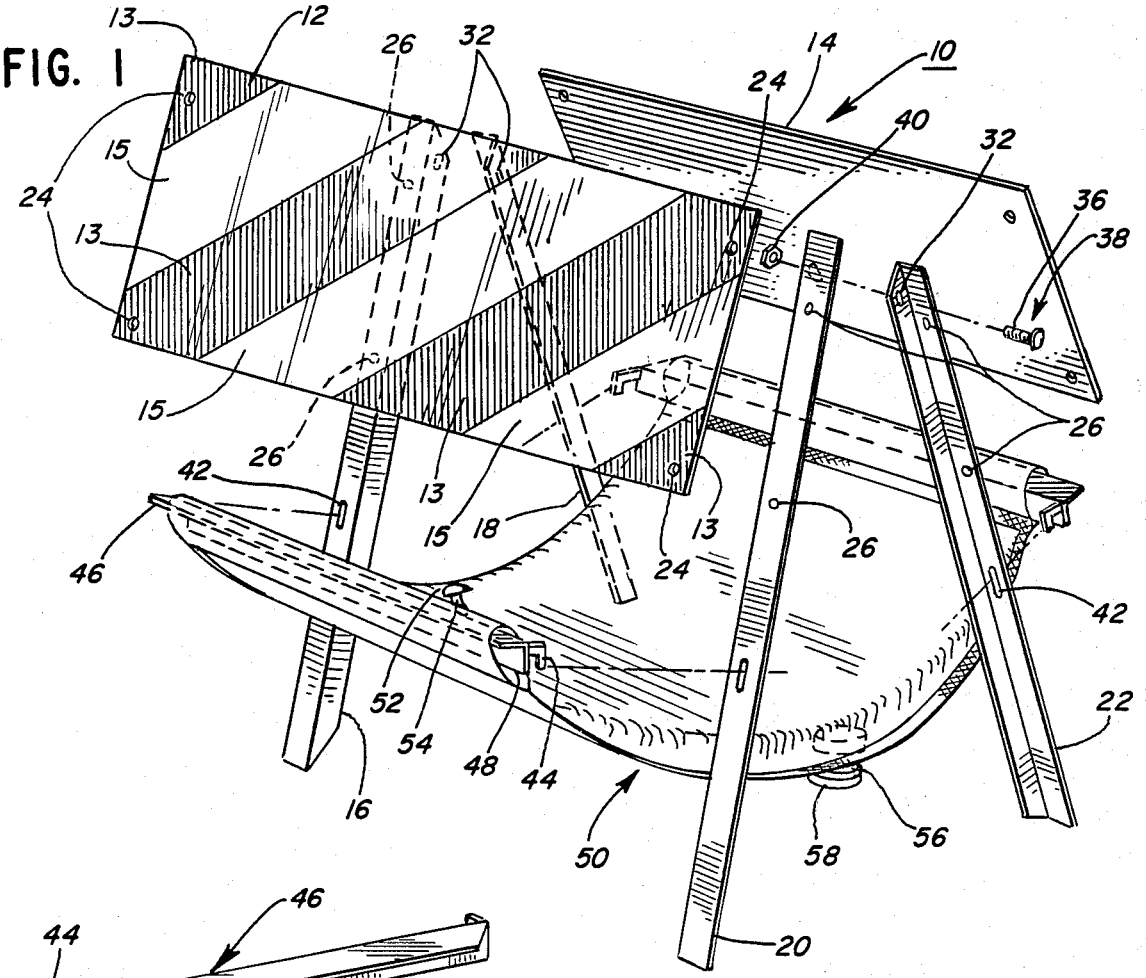
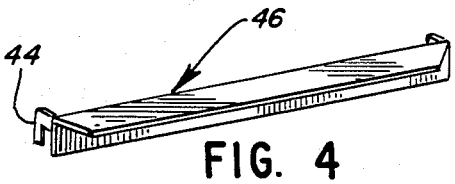
FIG. 4
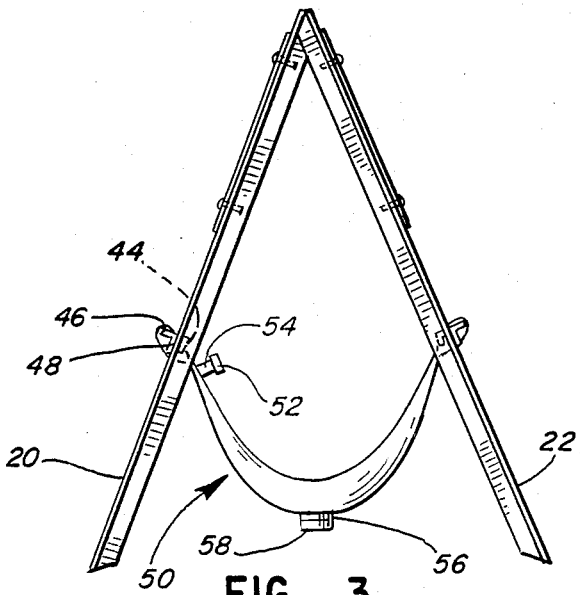
FIG. 3
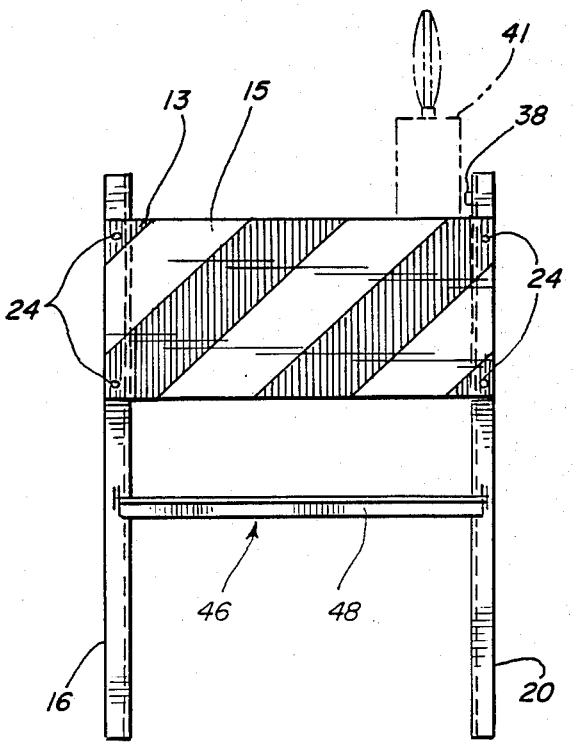
FIG. 2

PORTABLE TRAFFIC BARRIER

BACKGROUND OF THE INVENTION

1. Field of the Invention

The present invention relates to traffic barrier and particularly to a traffic barrier which is light in weight for ease of moving prior to use, and to which a stabilizing ballast material may be readily added after the barrier is place for use in a desired location. The ballast material stabilizes the barrier, which would otherwise be easily tipped over by gusts of wind, such as are created by passing trucks and automobiles. Further, the barrier uses a ballast material which in most cases may be readily disposed of without adverse environmental effects at the location where the barrier has been used.

2. Prior Art

Barriers having high visibility panels, which are intended to be easily seen, are customarily positioned at a construction site, adjacent the traveled portion of a roadway, to separate the traffic from the construction site. The placement of barriers at a construction site can add considerable labor costs to the overall cost of the construction. The road barrier typically found in use today consists of one, or a pair, of rectangular vertically disposed panels supported by two pairs of legs, one pair at each end of the panel or panels. One leg of each pair is connected at its top end to one leg of the other pair, with the legs extending to the ground at an angle to each other. Generally such barriers have the general appearance of a typical saw horse. Due to the generally relative light weight construction of these barriers, which are typically formed of steel, aluminum, or plastic, it is necessary to add weight or ballast to them to prevent them from being easily tipped over. Typically a horizontal member or crossbar extends between the legs of each pair of legs close to the ground and a weight in the form of ballast material, such as a partially filled sandbag, is draped over the crossbar. Considerable labor is involved in placing such barriers at a construction site. Typically the barrier is unloaded from a truck and placed in a desired location. Thereafter, it is necessary to manually place the sandbags, which have already been partially filled with sand, over the crossbars. Since the barrier can be subjected to gusts of wind from both directions, it is normally desirable to place a partially filled sandbag over each of the crossbars. It can thus be seen that considerable labor is necessary to set up the barriers, both at the construction site and in preparing the sandbags for use. Further, when the construction project is completed and it is necessary to remove the barrier, again the sandbags must be removed from the crossbars and, in most cases, both the barrier and the sandbags must be loaded on a truck for removal from the construction site. If the ballast bag is filled with a material which is compatible with disposable on the construction site, the bags may be emptied alongside the road, such that only the bags themselves need be removed from the construction site.

Attempts have been made in the past to reduce the cost of erecting barriers at a construction site. For instance, a traffic barricade is set forth in U.S. Pat. No. 3,917,232, issued Nov. 4, 1975, to Henry Lidner, which discloses a traffic barricade formed of molded parts with a open top box extending between each pair of legs. It is suggested in the Lindner patent that weighted material of various kinds can be disposed within the box to anchor the barricade. A plurality of drain holes are provided in the boxes for drainage of collected water resulting from rain or splashing.

U.S. Pat. No. 4,104,980, issued Aug. 8, 1978, to John Toomey, discloses a collapsible road barrier provided with a universally collapsible bunk of generally rectangular shape with each of the four corners of the bunk being attached to one of the supporting legs of the barrier. After the barrier is positioned in the desired location, it is intended that a material be positioned on the collapsible bunk to add stability to the road barrier.

While the road barriers described in each of the above-mentioned patents eliminate the need for filling and positioning sandbags on the crossbars of a barrier, they still require that a ballast material, such as sand or gravel, be provided for use at the construction site, to be placed in the boxes of the Lindner patent, or on the collapsible bunk of the Toomey patent.

It is a object of the present invention to provide a collapsible traffic barrier of light weight construction, which is readily movable to a construction site, and which includes a container in which may be placed liquid to serve as a ballast to stabilize the barrier.

It is another object of this invention to provide a light weight, readily movable traffic barrier, including a container for receiving a liquid such as water for ballasting, which container includes a pair of closable openings, one for readily adding fluid to the container, and the other for readily removing fluid from the container.

SUMMARY OF THE INVENTION

The present invention provides a traffic barrier, including high visibility panels supported by two pairs of legs. A pair of legs is located at each end of the panels, with the lower ends of each pair of legs being spaced from each other. One leg of each pair is connected by a cross-member or crossbar to the corresponding leg of the other pair. A flexible substantially closed container extends under the high visibility panels and is supported from the four legs. The container is supported either directly from the legs or from the crossbars. A closable fill hole is provided in the container at a location which provides for ease in filling the container with a liquid, such as water or brine. A second closable opening is provided in the container for readily emptying the liquid from the container.

BRIEF DESCRIPTION OF THE DRAWINGS

FIG. 1. is a perspective view illustrating a traffic barrier in accordance with the present invention;

FIG. 2 is a side elevation view of the traffic barrier shown in FIG. 1;

FIG. 3 is an end elevation view of the traffic barrier shown in FIG. 1;

FIG. 4 is a perspective view of the cross-member of the traffic barrier shown in FIG. 1;

DESCRIPTION OF THE PREFERRED EMBODIMENT

Figure 5:
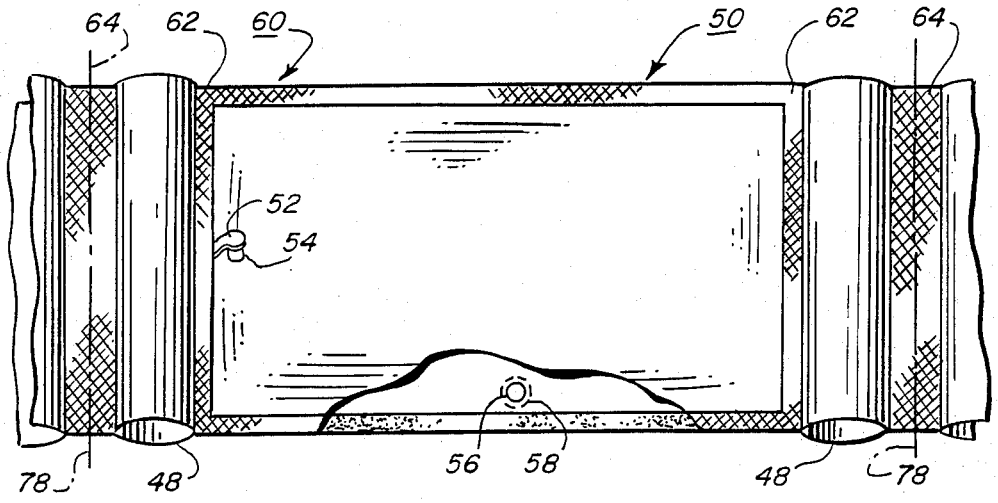
FIG. 5 is a perspective view of the manner in which the container used in the traffic barrier shown in FIG. 1 is formed.

Referring to FIG. 1 of the drawings, the portable traffic barrier 10 of this invention includes a pair of high visibility rectangular panels 12 and 14 which are supported by two pairs of legs, 16 and 18, 20 and 22. The panels 12 and 14 are preferably formed of a material which will have a long useful life in the environment to which they are exposed. Suitable materials are steel with a protective finish, aluminum, and fiberglass or plastic sheets. As is well known, each of the materials has its own particular advantages. The panels are provided with a highly visible finish, such as by painting with alternating red 13 and white 15 reflective stripes. Holes 24 are provided in the panels 12 positioned to be aligned with holes 26 in legs 16 and 18, 20 and 22. Rivets or other fastening devices, such as bolts or snap fasteners, are placed in the holes to secure the panels 12 and 14 to the legs 16 and 18, 20 and 22. Holes 32 are provided near the upper ends of the legs 16 and 18, 20 and 22 to receive the shanks 36 of bolts 38. Nuts 40 engage the shanks 36 of the bolts 38 to pivotally secure the legs 16 and 18, 20 and 22 to each other. While the use of a bolt and nut is shown, other fastening devices, such as rivets or snap fasteners, might also be utilized. One of the bolts 38 may be of extended length so as to support a signal light 41 on top of the barrier as shown in FIG. 2.

Each of the legs 16 and 18, 20 and 22 is provided with a slot 42 for receiving a tang 44 formed on a crossbar 46 which has a L-shaped cross-section as is best seen in FIG. 2. Prior to securing the tangs 44 in the slots 42, the crossbar 46 is passed through an elongated tubular aperture 48 formed in a flexible substantially closed container 50. After the crossbars 46 are passed through the apertures 48, the tangs 44 are engaged in the slots 42 to complete the assembly of the traffic barrier. It should be noted that the crossbar 46 not only serves to support the container 50, but also provides rigidity to the traffic barrier. The traffic barrier in accordance with this invention may be compactly stored by pivoting the legs 16 and 18, 20 and 22 about the bolts 36 such that they are close to parallel to each other. Since the container 50 is flexible, the legs may even be collapsed with the container 50 mounted on the crossbars 46, and the crossbars secured on the legs.

When the traffic barrier is to be placed at a construction site, the legs 16 and 18, 20 and 22 are pivoted about the bolts 38 to move the legs away from each other and to stretch the container 50 under the panels 12 and 14. With the traffic barrier thus set up, it is a relatively easy procedure to fill the container 50 from a truck carrying a tank provided with a hose and nozzle. The container 50 is provided with a fill spout 54, to the open end of which is secured a closing cap 52. With the nozzle inserted in the fill spout 54, the desired amount of liquid may be injected into the container 50. All that remains to be done to complete the installation of the barrier is to replace the cap 52 on the fill spout 54. The cap 52 may be attached to the fill spout 54 by a flexible means, such as an integrally formed flexible member, such that it is always readily available.

When the construction project has been completed, and it is desirable to move the barrier, the ballast liquid is removed from the container 50. For this purpose a drain spout 56 having a cap 58, is provided on the container 50. With the mere removal of the cap 58, the ballast liquid may be drained from the container 50 at the construction site.

Referring to FIG. 5, the method of forming the flexible substantially closed container 50 is shown. An elongated tubular member, typically formed from a plastic, such as an polyolefin or a polyvinylchloride (PVC), or from nylon or other suitable material, is sealed or welded closed at spaced portions 62 and 64. The flexible container 50 formed between the sealed portions 62 is provided with the fill spout 54 and cap 52, and drain spout 56 and cap 58. As shown in FIG. 5, the flexible container 50 may be formed from a continuous elongated tubular member 60 with each container 50 being separated from the continuous elongated tubular member by cutting the continuous elongated tubular member at 78 within the sealed portion 64. The tubular aperture 48 is formed in the elongated tubular member 60 between the sealed portions 62 and 64.

Figure 7:
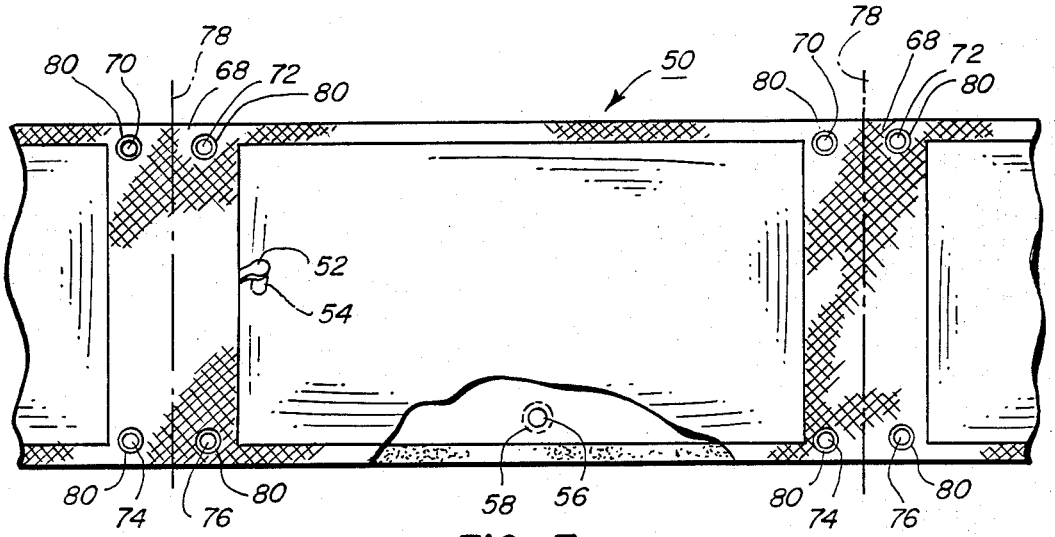
FIG. 7 is an alternate embodiment of the manner in which the container is formed for use with the alternate cross-member shown in FIG. 6.
Figure 6:
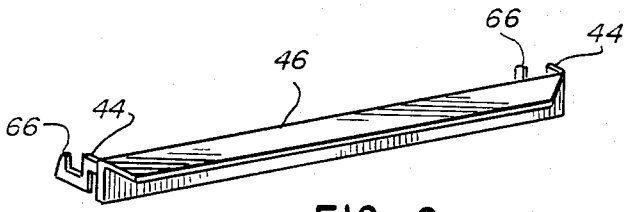
FIG. 6 is an alternate embodiment of the cross-member utilized in the traffic barrier shown in FIG. 1.

In an alternate embodiment of this invention, the cross-member 46 may be formed with hooks 66 extending from the tangs 44, as shown in FIG. 6. When the cross-members are formed in this way, the flexible container 50 is formed as shown in FIG. 7. In this alternate embodiment, the flexible containers 50 are separated from each other in the continuous elongated tubular member 60 by only one sealed portion 68. The sealed portion 68 is provided with four apertures 70 and 72, 74 and 76, which are located upon opposite sides of the dashed line 78 along which the containers 50 ar separated from each other.

In the embodiment shown in FIGS. 6 and 7, after the crossbars 46 are installed with the tangs 44 engaged in the slots 42, the holes 70 and 72, 74 and 76, are engaged on the hooks 66 to support the container 50 in a manner similar to that set forth with respect to the preferred embodiment. It may be desirable when using containers formed as shown in FIG. 7, to reinforce the holes 70 and 72, 74 and 76 with grommets 80 as shown in FIG. 7.

Depending upon how and where the traffic barrier of this invention is to be used, it may be desirable to form the barrier from different materials. As previously discussed, the panels 12 and 14 can be formed, for instance, from coated steel, plastic, or fiberglass, amongst other materials. Similarly, the legs 16 through 22 and the crossbars 46 can be formed from metals such as steel or aluminum, or from fiberglass or plastic. There are several advantages of forming the panels, legs, and crossbars from plastic, in that if a vehicle should hit the barrier, less damage may be done to the vehicle and to the barrier then is the case where the panels, legs and crossbars are formed of a metal. A suitable plastic of which to form the panels, legs, and crossbars is high density molecular polyethylene, PVC, or other similar material. A suitable material for the container is three-ply nylon.

Generally the most desirable liquid with which to fill the container is water, since when use of the barrier is completed, the water may be drained on site without any concern for adverse effects on the local environment. When it is necessary to utilize the barrier in regions in which water would freeze, it may be desirable to use brine or some other liquid which would not freeze, but which at the same time would not be considered unnecessarily harmful to the environment were the container to be broken accidentally or drained at the work site upon completion of the work. As previously set forth, there are great practical advantages in being able to drain the liquid from the container on the construction site, as compared to having to dispose of sandbags or granular material placed in some other type of container, such as illustrated in the patents set forth in the Background of the Invention.

While in accordance with the U.S. Patent Statutes, preferred embodiments of the invention have been shown and described, various changes may be made in the traffic barrier of this invention, without departing from the true spirit and scope of this invention.

The appended claims are intended to cover all such changes and modifications as fall within the true spirit and scope of the invention. In this regard the physical location of the fill and drain spouts may be located at the center or at opposite edges of the container.

I claim:

1. A portable road barrier comprising:

at least one high visibility panel;

legs for supporting said at least one panel;

a flexible substantially closed container;

means for supporting said container from said legs, such that said container is located beneath said at least one panel and between said legs when said barrier is positioned for use;

fill means provided on said container for readily introducing a fluid into said container, whereby the weight of said fluid will result in a low center of gravity for said barrier, so as to stabilize said barrier during use;

discharge means provided on said flexible container for discharging said fluid from said container, whereby the weight of said barrier may be reduced for moving and storage.

2. The portable road barrier of claim 1, wherein there are two high visibility panels, and two pairs of legs, each of which pairs includes a first leg and a second leg, each of said panels extends between one of the legs of each of said pairs of legs, said first leg and said second leg of each of said pairs of legs being pivotally connected to each other, said container having at least two ends, including a first end and a second end, said means for supporting said container from said legs supporting said first end of said container from said first leg of each of said pairs of legs, and said second end of said container form said second leg of each of said pairs of legs.

3. The portable road barrier of claim 2, wherein said means for supporting said container from said legs includes at least a first cross-member and a second cross-member, said first cross-member extending between said first legs of each of said pairs of legs, and said second cross-member extending between said second legs of each of said pairs of legs.

4. The portable road barrier of claim 3, wherein said container is formed with tubular portions at each end, each of said tubular portions receiving one of said first and second cross-members, whereby the container is supported from said legs by said cross-members.

5. The portable road barrier of claim 1, wherein said fill means comprises a tubular member extending from said container.

6. The portable road barrier of claim 5, wherein said tubular member extends upwardly from said container adjacent one of said first and second cross-members.

7. The portable road barrier of claim 6, wherein said tubular member is provided with a closure means.

* * * * *